US005298954A

United States Patent [19]

Fujita et al.

[11] Patent Number: 5,298,954

[45] Date of Patent: Mar. 29, 1994

[54] IMAGE FORMING APPARATUS

[75] Inventors: Shigeo Fujita, Moriguchi; Ryuji Wataki, Nara, both of Japan

[73] Assignee: Mita Industrial Co., Ltd., Osaka, Japan

[21] Appl. No.: 958,732

[22] Filed: Oct. 9, 1992

[30] Foreign Application Priority Data

Oct. 15, 1991 [JP] Japan ..... 3-266447

[51] Int. Cl.[5] ..... G03G 15/16

[52] U.S. Cl. ..... 355/274; 355/277

[58] Field of Search ..... 355/219, 271, 274, 277, 355/315

[56] References Cited

U.S. PATENT DOCUMENTS

| | | | |
|---|---|---|---|
| 3,781,105 | 12/1973 | Meagher | 355/274 |
| 4,101,212 | 7/1978 | Sumiyoshi et al. | 355/274 |
| 4,363,550 | 12/1982 | Toshimitsu et al. | 355/315 |
| 4,408,863 | 10/1983 | Ogata et al. | 355/271 |
| 4,431,301 | 2/1984 | Hashimoto et al. | 355/274 |
| 4,575,216 | 3/1986 | Hebert et al. | 355/274 |
| 4,806,985 | 2/1989 | Foley et al. | 355/315 |
| 4,931,839 | 6/1990 | Tompkins et al. | 355/277 |
| 5,012,293 | 4/1991 | Aldrich et al. | 355/274 |

OTHER PUBLICATIONS

Abstract vol 11, #12 (P-535)(2459) relating to JP-A-61 188569 Jan. 13, 1987 JPX.

Abstract v. 7, No. 212(P-224)(1357) relating to JP-A-58 106580 Sep. 20 1983 JPX.

Abstract v. 10, #3 30(P-514)(2386) relating to JP-A-61 137178 Nov. 11, 1986 JPX.

*Primary Examiner*—Fred L. Braun

*Attorney, Agent, or Firm*—Beveridge, DeGrandi, Weilacher & Young

[57] ABSTRACT

An image forming apparatus includes an electric charge removing device for elastically coming in contact with a photoreceptor when there is no paper and for removing electric charges from the paper which is delivered, and a control device for starting to apply voltage to a transferring roller at a timing which is earlier by a predetermined time than a timing when the leading edge of the paper arrives at a transferring position and for releasing the application of the voltage to the transferring roller at a timing which is later by a predetermined time than a timing at which the trailing edge of the paper passes through the transferring position.

7 Claims, 6 Drawing Sheets

IMAGE FORMING APPARATUS

BACKGROUND OF THE INVENTION

The present invention relates to an image forming apparatus such as a copying machine or a laser beam printer, and more particularly to an image forming apparatus in which a transferring roller is used.

In a conventional machine such as a copying machine, there has been known a so-called transferring roller system in which an electric charge having a first polarity is given to a photoreceptor in order to form an optical image as image information projected onto the photoreceptor; from the optical image, an electrostatic latent image is formed; the electrostatic latent image is then developed by toner having a second polarity (or the first polarity in reverse development) to form a toner image; and the toner image is transferred onto a paper interposed between the photoreceptor and a transferring roller. Voltage (including an earth) having a polarity which is different from that of the toner is usually applied to the transferring roller so that the transferring roller gives so-called back charges onto the surface of the paper which does not come in contact with the photoreceptor.

In the transferring system, because excessive back charges to the paper, which are required in transfer by corona discharge are not necessary, it is possible to prevent the toner on the photoreceptor from being drawn onto the paper in the former and latter transferring steps, so that the transferring system suppresses image forming in which toner scatters around letters. The paper is interposed between the photoreceptor and the transferring roller so as to come in contact with the photoreceptor side by predetermined pressing force. Consequently, the paper is surely delivered and therefore a transfer drift, which may occur due to the slippage of the paper on the photoreceptor can be prevented.

However, when reverse development is mainly carried out to form an image having a relatively low printing ratio (which has many white portions), the paper which passed between the photoreceptor and the transferring roller might draw onto the photoreceptor side by electrostatic suction force generated by the back charges of the paper and the surface charges of the photoreceptor. This causes unstable separation of the paper from the photoreceptor.

Consequently, there has been provided an image forming apparatus including a needle for removing electric charges from the paper which is provided at the vicinity of the downstream in the paper delivery direction of the transferring roller in order to stably separate the paper from the photoreceptor (see Japanese Unexamined Patent Publication No. 269969/1989).

Because the electric charge removing needle is made of a conductive rigid body such as stainless steel, it should be displaced from the photoreceptor by a predetermined distance so as not to damage the photoreceptor. Accordingly, the electric charge removing needle cannot surely come in contact with the back of the paper, so that electric charges cannot sufficiently be removed from the paper and the paper winds around the photoreceptor. For this reason, the separation of the paper from the photoreceptor cannot be stabilized.

It is an object of the present invention to solve the technical problems above and to provide an image forming apparatus capable of stabilizing the separation of a paper from a photoreceptor.

It is another object of the present invention to solve the technical problems and to provide an image forming apparatus of which manufacturing costs can be reduced.

SUMMARY OF THE INVENTION

In order to achieve the objects, the present invention provides an image forming apparatus comprising a developing device for developing an electrostatic latent image formed on a photoreceptor, a transferring roller for transferring the developed image onto a paper, electric charge removing means provided at the downstream side of the transferring roller in the paper delivery direction for elastically coming in contact with the photoreceptor when there is no paper, and removing electric charges from the paper which is delivered, and control means for starting to apply voltage to the transferring roller at a timing which is earlier by a predetermined time than a timing at which the leading edge of the paper arrives at a transferring position, and releasing the application of the voltage to the transferring roller at a timing which is later by a predetermined time than a timing at which the trailing edge of the paper passes through the transferring position.

In the image forming apparatus having the structure above, the electric charge removing means elastically comes in contact with the photoreceptor. Consequently, the electric charge removing means surely comes in contact with the transferred paper so that the electric charges can surely be removed from the paper. Thus, the paper can stably be separated from the photoreceptor. Furthermore, the electric charge removing means elastically comes in contact with the photoreceptor so that the photoreceptor is not damaged.

The control means applies voltage to the transferring roller during predetermined times before and after the paper passes through the transferring position. Consequently, even when the alignment of the paper with a toner image on the photoreceptor is slightly shifted in a transferring area and when the toner is drawn onto a portion of the photoreceptor surface which is downstream of a portion in the rotary direction where the leading edge of the paper comes in contact with or onto a portion of the photoreceptor surface which is upstream of a portion in the rotary direction where the trailing edge of the paper comes in contact with, the toner is sucked into the transferring roller side before arriving at the electric charge removing means. Accordingly, even though the electric charge removing means comes in contact with the photoreceptor as described above, the toner is not drawn onto the electric charge removing means side. Consequently, it is possible to prevent the electric charge removing means from becoming dirty.

BRIEF DESCRIPTION OF THE DRAWINGS

These and other features, objects, and advantages of the present invention will be more fully apparent from the following detailed description set forth below when taken in conjunction with the accompanying drawings wherein the same members have the same reference numerals throughout and.

DETAILED DESCRIPTION OF THE PREFERRED EMBODIMENTS

Preferred embodiments of the present invention will be described in detail with reference to the accompanying drawings.

Figure 1:
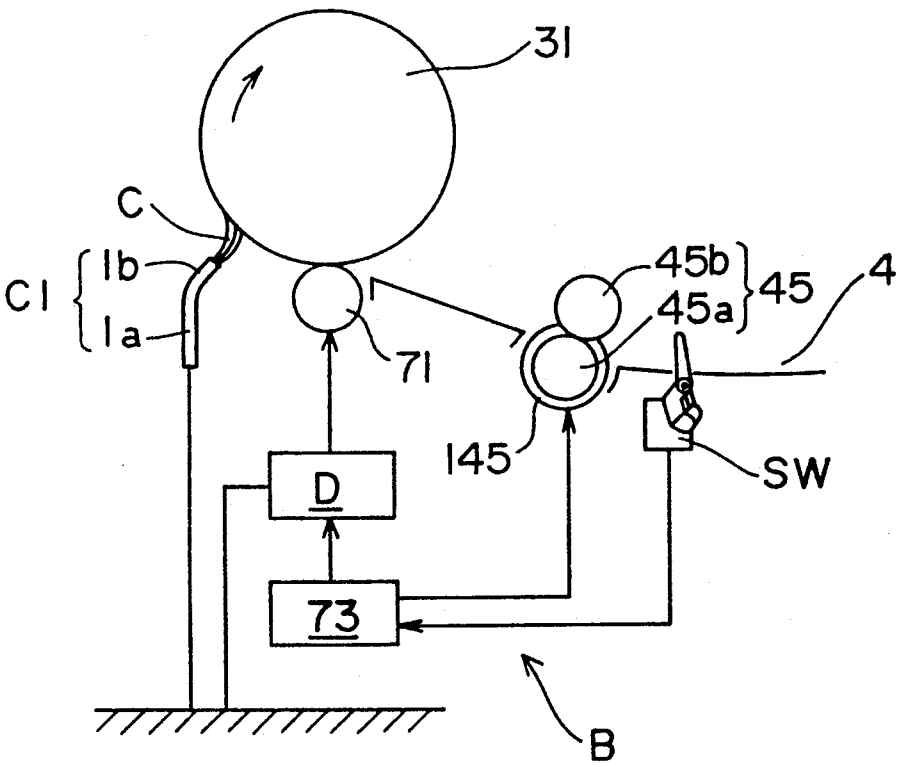
FIG. 1 is an enlarged schematic view showing the structure of a main part of a copying machine as an image forming apparatus according to an embodiment of the present invention.
Figure 2:
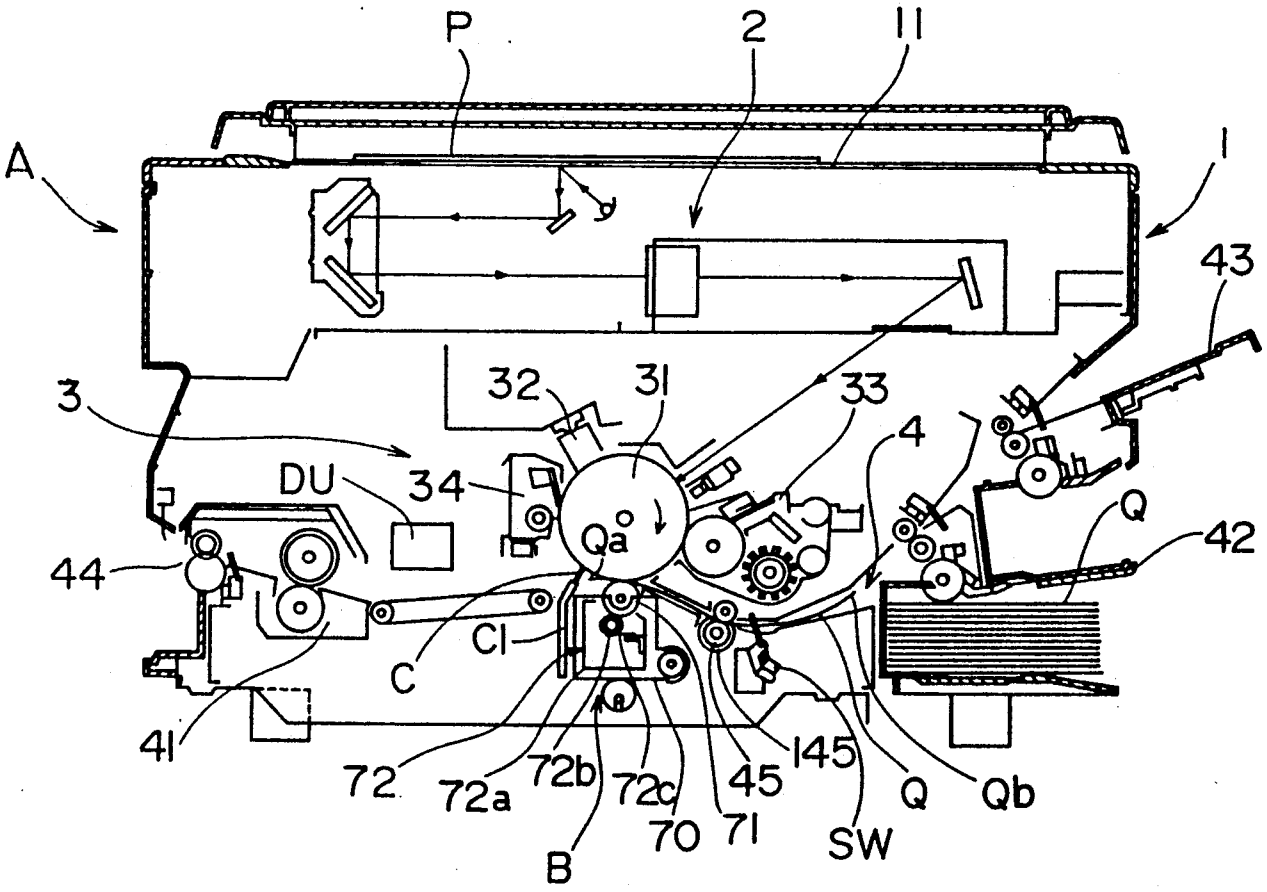
FIG. 2 is a schematic view showing the structure of the copying machine.

FIG. 1 is an enlarged schematic view showing the structure of a main part of a copying machine as an image forming apparatus according to an embodiment of the present invention. FIG. 2 is a schematic view showing the structure of the copying machine.

With reference to FIG. 2, a copying machine A in this embodiment has an optical system 2, image forming device 3, and paper delivery device 4 provided in a body 1. The optical system 2 serves to illuminate and scan a document P' placed on a contact glass 11 and to guide light reflected by the document P to a photoreceptor drum 31 as a photoreceptor. The image forming device 3 serves to develop an electrostatic latent image formed on the photoreceptor drum 31 by means of a developing device 33 and then transfer the developed image onto a paper Q by means of a transferring roller 71. The paper delivery device 4 has an image fixing device 41 provided midway, and serves to lead the paper Q from a paper feeding cassette 42 or paper feeding tray 43 to the inside of the body 1 and then discharge the paper Q from a paper discharging device 44 through the image forming device 3. The image fixing device 41 serves to fix a toner image transferred onto the paper Q.

The image forming device 3 is formed by an electrostatic charger 32, the developing device 33, a transferring device B, electric charge removing means C, and a cleaner 34 arranged in that order around the photoreceptor drum 31 in the rotary direction of the photoreceptor drum 31.

A pair of resist rollers 45 are provided at the upstream of the transferring device B in the paper delivery passage of the paper delivery device 4. The resist rollers 45 include a drive roller 45*a* and a driven roller 45*b*, and serve to halt the paper Q led from the paper feeding cassette 42 or paper feeding tray 43 and to deliver the paper Q at a timing corresponding to the image position on the photoreceptor drum 31. The drive roller 45*a* is connected to a drive system DU through a clutch 145. The clutch 145 connects or disconnects power from the drive system DU. The connecting and disconnecting operations of the clutch 145 are controlled by control means 73 to be described below.

A resist switch SW is provided at the upstream of the resist rollers 45 in order to detect the paper Q delivered to the resist rollers 45. As shown in a timing chart of FIG. 3, when the paper Q delivered from the paper feeding cassette 42 or paper feeding tray 43 comes in contact with the resist switch SW at a timing a, the resist switch SW outputs a detection signal for detecting a leading edge Qa of the paper Q (see FIG. 4) at the timing a. When a trailing edge Qb of the paper Q (see FIG. 5) passes at a timing b, the resist switch SW is turned OFF at the timing b.

The transferring device B of the image forming device 3 includes a casing 70, a transferring roller 71, and a cleaning device 72. The transferring roller 71 is pivoted on the upper end of the casing 70 for holding the paper together with the photoreceptor drum 31. The cleaning device 72 is provided in the casing 70 for scraping off toner stuck to the transferring roller 71.

The cleaning device 72 has a casing 72*a*, a fur brush 72*b*, and a blade 72*c*. The fur brush 72*b* is provided in the casing 72*a* for coming in contact with the peripheral surface of the transferring roller 71. The blade 72*c* is disposed in the casing 72*a* and comes in contact with the fur brush 72*b* to scrape off the stuck toner into the casing 72*a*.

As shown in FIG. 1, the transferring device B of the image forming device 3 includes a potential circuit D and conrol means 73. The potential circuit D serves to apply a voltage to the transferring roller 71. The control means 73 is provided for controlling voltage application.

With reference to FIG. 1, the potential circuit D is formed by a transformer and other electrical equipments, and serves to apply a predetermined voltage (for example, 2 KV) to the transferring roller 71 based on the control of the control means 73.

The control means 73 is formed by a microcomputer and other electrical equipments, and serves to operate the clutch 145 of the resist rollers 45 and the potential circuit D on predetermined conditions based on the detection signal from the resist switch SW.

Figure 3:
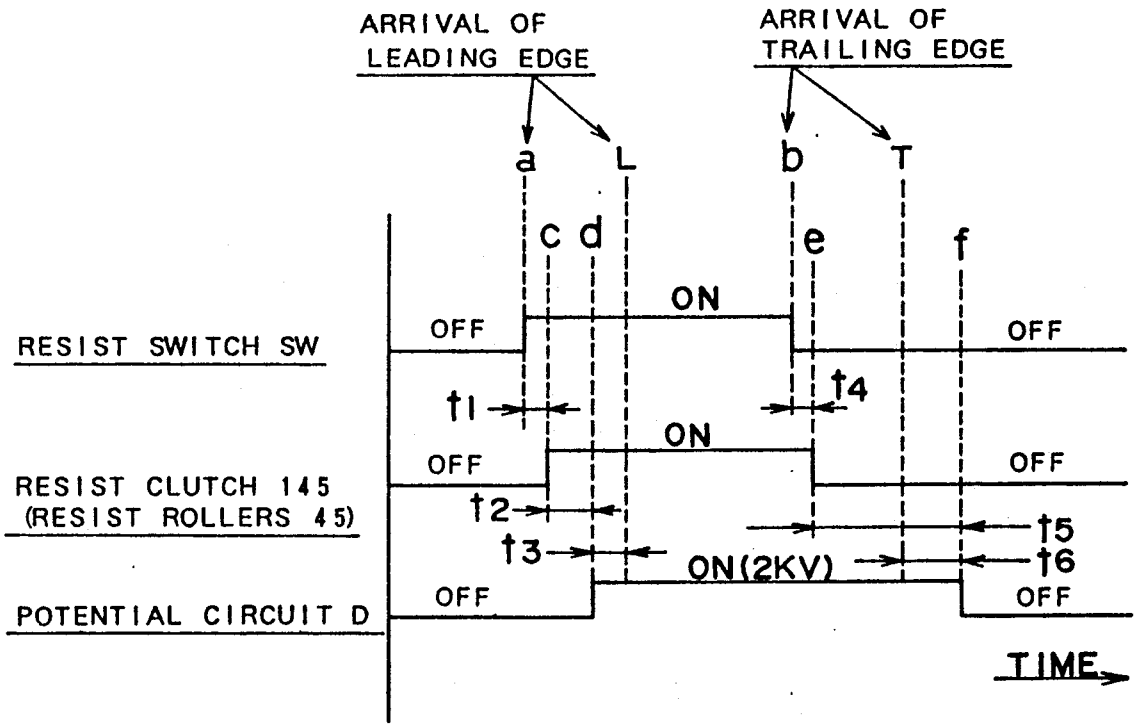
FIG. 3 is a timing chart.
Figure 4:
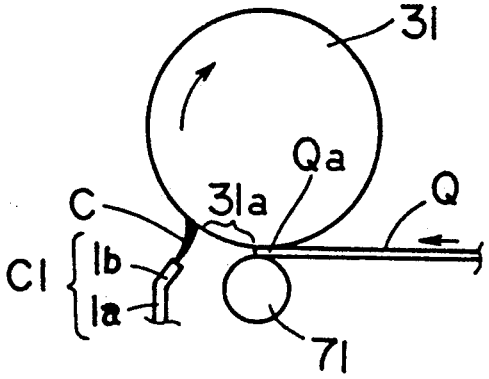
FIG. 4 is a schematic view showing a main part of the state in which the leading edge of a paper arrives at a transferring position.

The control means 73 will be described in more detail with reference to the timing chart of FIG. 3. The control means 73 drives the clutch 145 to be brought into the state of connection at a timing c: a timing when a predetermined time t1 (for example, several msecs.) passes since the timing a at which the resist switch SW is turned ON. Thus, power is transmitted from the drive system DU to the resist rollers 45 and the resist rollers 45 deliver the paper Q to the photoreceptor drum 31 side. As a result, the leading edge Qa of the paper Q arrives at a transferring position at a timing L (see FIG. 4). Then, the control means 73 drives the potential circuit D at a timing d: a timing when a predetermined time t2 (for example, 50 msecs.) passes since the timing c at which the resist clutch 145 is connected. Thus, the potential circuit D applies voltage, for example, of 2 KV to the transferring roller 71. The timing d is set earlier by a predetermined time t3 (for example, 250 msecs.) than the timing L at which the leading edge Qa of the paper Q arrives at the transferring position shown in FIG. 4.

Figure 5:
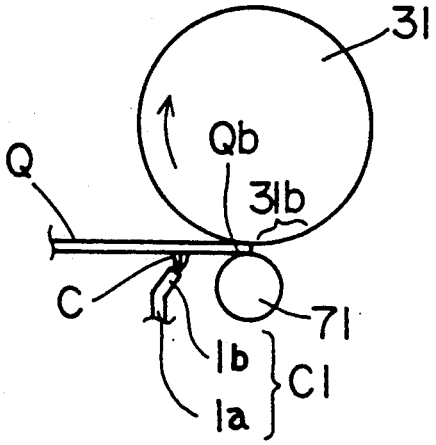
FIG. 5 is a schematic view showing a main part of the state in which the trailing edge of the paper arrives at the transferring position.

The control means 73 drives the clutch 145 to be brought into the state of disconnection at a timing e: a timing when a predetermined time t4 (for example, several msecs.) passes since the timing b at which the resist switch SW is turned OFF. Thus, the power from the drive system DU to the resist rollers 45 is interrupted. The trailing edge Qb of the paper Q arrives at the transferring position as shown in FIG. 5 by setting the predetermined time t4 between the timings b and e. The control means 73 releases the voltage application of the potential circuit D at a timing f: a timing when a predetermined time t5 (for example, 350 msecs.) passes since the timing e at which the resist clutch 145 is disconnected. Thus, the voltage application of the potential circuit D to the transferring roller 71 is released. The timing f is set later by a predetermined time t6 (for example, 50 msecs.) than a timing T at which the trailing edge Qb of the paper Q arrives at the transferring position shown in FIG. 5.

The operation of the image forming device 3 according to the embodiment will be described with reference to FIG. 2.

Uniform electric charges having a negative polarity are given to the surface of the photoreceptor drum 31 by the electrostatic charger 32. The optical system 2 irradiates light corresponding to a document image onto the photoreceptor drum 31 charged. Consequently, the surface of the photoreceptor drum 31 is divided into a portion having low potential due to the irradiated light and a portion having high potential due to the shadow of the irradiated light. Development on the portion having the low potential is so-called reverse development in which the electrostatic latent image is developed by toner having a negative polarity supplied from the developing device 33. The image thus developed on the photoreceptor drum 31 is copied on the paper Q fetched out from the paper feeding cassette 42 and led into the transferring position (between the photoreceptor drum 31 and the transferring roller 71) by adjusting a timing by means of the resist rollers 45. After a transferring step is completed, residual toner on the photoreceptor drum 31 is removed by the cleaner 34.

The electric charge removing means C is in the form of a brush made of a flexible material such as conductive rayon or stainless fiber which does not damage the photoreceptor drum 31 at the time when the material comes in contact with the photoreceptor drum 31. The electric charge removing means C comes in contact with the photoreceptor drum 31 over the width in the longitudinal direction of the photoreceptor drum 31 with being supported by a supporting member C1. The supporting member C1 includes a base portion 1*a* and a bending portion 1*b*. The base portion 1*a* is provided in the perpendicular direction to the paper delivery direction. The bending portion 1*b* bends from the upper end of the base portion 1*a* toward the upstream side of the paper delivery direction. The electric charge removing means C is supported by the bending portion 1*b*. When the supporting member C1 having such a structure is adopted, the electric charge removing means C can elastically come in contact with the surface of the photoreceptor drum 31 at the side of the leading edge Qa of the paper Q urged toward upstream in the paper delivery direction in such a state that the paper Q is not delivered. When the paper Q is delivered, the leading edge Qa of the paper Q is delivered downstream pushing the electric charge removing means C. As a result, the paper Q can surely come in contact with the electric charge removing means C.

When the above-mentioned reverse development is carried out, it is desired that the electric charge removing means C is earthed or has the same polarity as that of the photoreceptor drum 31 so as to stabilize separation.

In the present embodiment, the electric charge removing means C comes in contact with the photoreceptor drum 31, so that the electric charge removing means C can come in contact with the transferred paper Q and surely remove electric charges from the paper Q. Accordingly, it is possible to prevent the paper from winding around the photoreceptor drum 31 because of insufficient electric charge removal. Thus, the paper can surely be separated from the photoreceptor drum 31. In addition, the electric charge removing means C is in the form of a flexible brush. For this reason, even though the electric charge removing means C comes in contact with the photoreceptor drum 31, the photoreceptor drum 31 is not damaged.

Also before and after the paper Q passes through the transferring position, or during the predetermined times t3 and t6, voltage is applied to the transferring roller 71 by the control means 73. Consequently, even when the alignment of the paper Q with a toner image on the photoreceptor drum 31 is slightly shifted in a transferring area and when the toner is drawn onto a portion 31*a* (see FIG. 4) of the surface of the photoreceptor drum 31 which is downstream of a portion in the rotary direction where the leading edge Qa of the paper Q comes in contact with or a portion 31*b* (see FIG. 5) of the surface of the photoreceptor drum 31 which is upstream of a portion in the rotary direction where the trailing edge Qb of the paper Q comes in contact with, the toner is sucked into the transferring roller 71 side before arriving at the electric charge removing means C. Accordingly, even though the electric charge removing means C comes in contact with the photoreceptor drum 31 as described above, the toner is not drawn onto the electric charge removing means C side. Consequently, it is possible to prevent the electric charge removing means C from becoming dirty.

There will be described another embodiment of the present invention with reference to FIG. 6.

Figure 6:
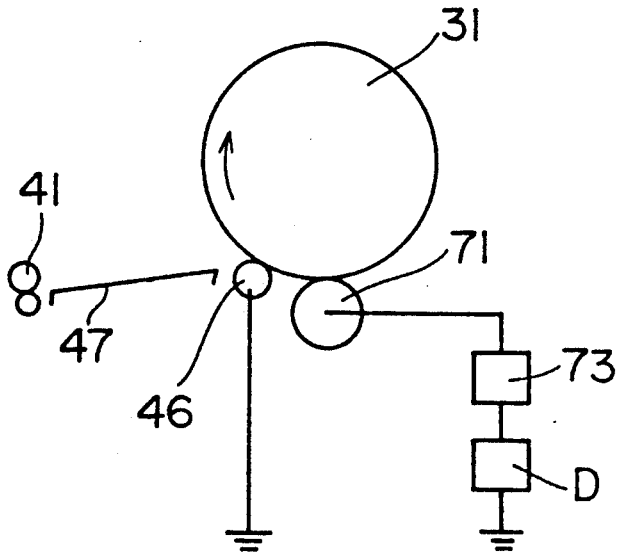
FIG. 6 is an enlarged schematic view showing the structure of a main part of a copying machine as an image forming apparatus according to another embodiment of the present invention.

FIG. 6 is an enlarged schematic view showing the structure of a main part of a copying machine as an image forming apparatus according to the present embodiment.

With reference to FIG. 6, a copying machine A in this embodiment comprises paper delivery device by which a paper is fed from a paper feeding cassette 42 or paper feeding tray 43 to the inside of a body 1, caused to pass through image forming device 3, delivered to an image fixing device 41 through a delivery roller 46 and a delivery guide 47, and discharged from a paper discharging device 44.

The delivery roller 46 comes in contact with the surface of a photoreceptor drum 31 at the downstream of a transferring roller 71. In addition, the delivery roller 46 is a conductive roller made of nickel or the like, and comes in contact with the photoreceptor drum 31 over the width in the longitudinal direction of the photoreceptor drum 31 and is earthed. The conductive delivery roller 46 thus earthed is caused to come in contact with the photoreceptor drum 31 to form electric charge removing means.

In the present embodiment, the conductive delivery roller 46 serves as the electric charge removing means, so that an electric charge removing means is not required other than the roller 46. Accordingly, the number of parts and manufacturing costs can be reduced.

Moreover, the delivery roller 46 forming the electric charge removing means can come in contact with the photoreceptor drum 31 over the length in the longitudinal direction of the photoreceptor drum 31. Consequently, electric charges can uniformly be attenuated over the width of the photoreceptor drum 31.

There will be described a further embodiment of the present invention with reference to FIG. 7.

Figure 7:
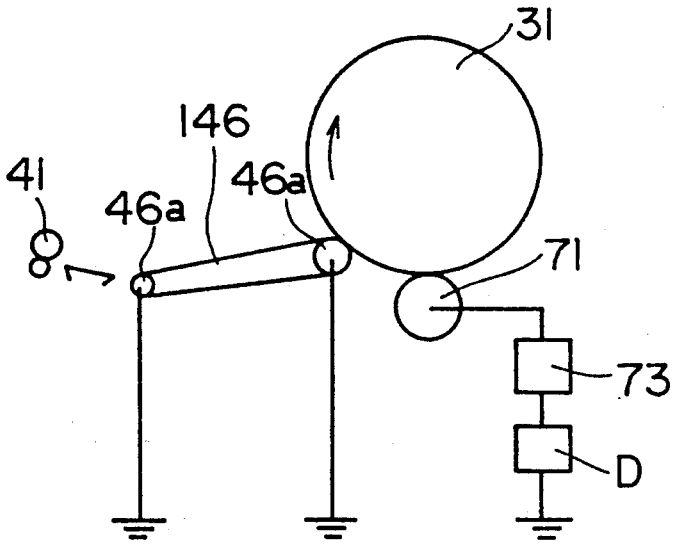
FIG. 7 is an enlarged schematic view showing the structure of a main part of a copying machine as an image forming apparatus according to a further embodiment of the present invention.

FIG. 7 is an enlarged schematic view showing the structure of a main part of a copying machine as an image forming apparatus according to the present embodiment.

With reference to FIG. 7, a copying machine A in this embodiment comprises paper delivery device by which a paper is fed from a paper feeding cassette 42 or paper feeding tray 43 to the inside of a body 1, caused to pass through image forming device 3, delivered to an image fixing device 41 through a delivery belt 146 and discharged from a paper discharging device 44.

The delivery belt 146 comes in contact with the surface of a photoreceptor drum 31 on the downstream side of a transferring roller 71. In addition, the delivery belt 146 is a conductive belt made of nickel or the like, and comes in contact with the photoreceptor drum 31 over the width in the longitudinal direction of the photoreceptor drum 31. A pair of rollers 46*a* which stretch the conductive delivery belt 146 are also conductive. The conductive delivery belt 146 is earthed through the rollers 46*a*. The conductive delivery belt 146 thus earthed is caused to come in contact with the photoreceptor drum 31 to form electric charge removing means.

Also in the present embodiment, the conductive delivery belt 146 also serves as the electric charge removing means, so that an electric charge removing means is not required other than the belt 146. Accordingly, the number of parts and manufacturing costs can be reduced.

Moreover, the delivery belt 146 forming the electric charge removing means can come in contact with the photoreceptor drum 31 over the length in the longitudinal direction of the photoreceptor drum 31. Consequently, electric charges can uniformly be attenuated over the width of the photoreceptor drum 31.

The present invention may be embodied in other specific forms without departing from the spirit or essential characteristics thereof. For example, the above-mentioned photoreceptor member may be in the form of belt-shaped component. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. An image forming apparatus comprising:

a developing device for developing an electrostatic latent image formed on a photoreceptor;

a transferring roller for transferring the developed image onto a paper;

electric charge removing means provided at the downstream side of said transferring roller in the paper delivery direction for elastically contacting the photoreceptor when there is no paper, and for removing electric charges from the paper as it is delivered; and control means for starting to apply voltage to said transferring roller at a time which is earlier by a predetermined time than a time at which the leading edge of the paper arrives at a transferring position, and releasing the application of the voltage to said transferring roller at a time which is later by a predetermined time than a time at which the trailing edge of the paper passes through the transferring position.

2. The image forming apparatus according to claim 1, wherein the electric charge removing means is a delivery roller made of a conductive material for delivering the paper to an image fixing means side of the image forming apparatus.

3. The image forming apparatus according to claim 1, wherein the electric charge removing means is a delivery belt made of a conductive material for delivering the transferred paper to an image fixing means side of the image forming apparatus.

4. The image forming apparatus according to claim 1, wherein the electric charge removing means is a conductive flexible member.

5. The image forming apparatus according to claim 4, wherein the flexible member is a brush-shaped member provided over the length of the photoreceptor in the width direction.

6. The image forming apparatus according to claim 5, further comprising a supporting member including a base portion provided in a direction perpendicular to the paper delivery direction and a bending portion which bends from the upper end of said base portion toward the paper delivery direction upstream side, said bending portion supporting the brush-shaped member.

7. The image forming apparatus according to claim 1, wherein the transferring roller is attached to a cleaning device, said cleaning device including a casing, a fur brush provided in said casing for contacting the peripheral surface of the transferring roller, and a blade fixed to said casing for contacting said fur brush to scrape toner stuck to the transferring roller into said casing.

* * * * *